United States Patent [19]

Martin, Jr. et al.

[11] 4,065,131

[45] Dec. 27, 1977

[54] BOARD GAME APPARATUS

[76] Inventors: Richard Thomas Martin, Jr., 10202 Club Creek Drive, No. 308, Houston, Tex. 77036; David Michael Engert, 2834 Ursulines St., New Orleans, La. 70119

[21] Appl. No.: 704,230

[22] Filed: July 12, 1976

[51] Int. Cl.[2] ..... A63F 3/00

[52] U.S. Cl. ..... 273/134 B; 273/134 D; 273/134 E

[58] Field of Search ..... 273/134

[56] References Cited

U.S. PATENT DOCUMENTS 3,885,792 5/1975 Breslow ..... 273/134 C

FOREIGN PATENT DOCUMENTS 848,768 9/1952 Germany ..... 273/134 AD

*Primary Examiner*—Delbert B. Lowe
*Attorney, Agent, or Firm*—Stephen S. Sadacca

[57] ABSTRACT

A board game apparatus includes a board having first and second alternate travel paths which have different numbers of movement steps and which are coincident in certain portions thereof. The players of the game evaluate and assess the relative risks and merits in selecting the alternate paths of movement during play of the game. Each traverse around the board corresponds to a college semester. A manual is provided with special entries indicating bonuses and penalties which correspond to typical college experiences. The bonuses and penalties are divided according to classification: freshman, sophomore, etc., with different bonuses and penalties being indicated depending upon the particular path of travel selected. The object of the game is to graduate having the highest grade point average.

15 Claims, 12 Drawing Figures

Fig. 6
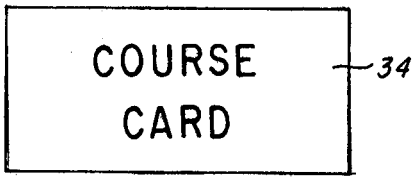
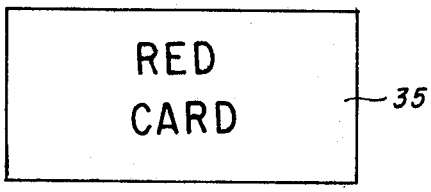
Fig. 7
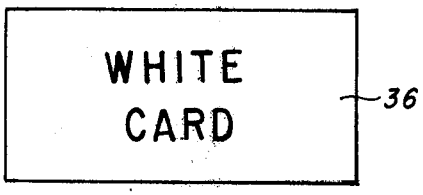
Fig. 8
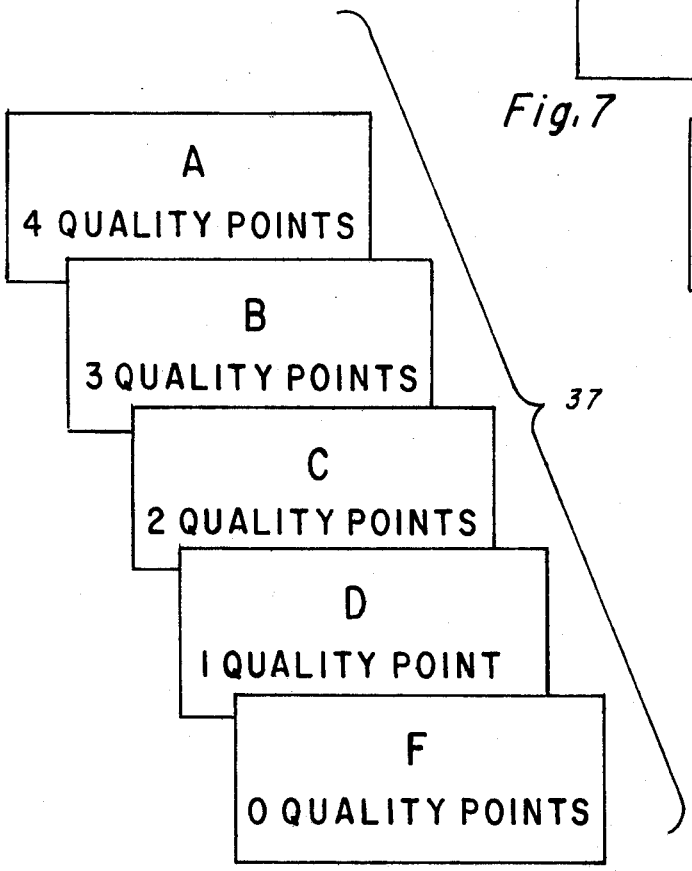
Fig. 9
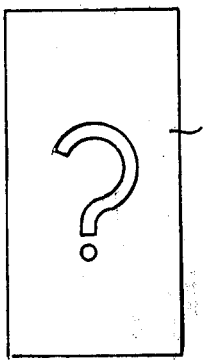
Fig. 10

BOARD GAME APPARATUS

BACKGROUND OF THE INVENTION

This invention relates to board game apparatus and more particularly to a new and improved game wherein the players of the game evaluate and assess the relative risks and merits of alternate paths of movement and travel to a desired goal during play of the game.

While the preferred embodiment of the game, "Magna Cum Laude," is basically one of skill and chance, it is based upon typical experiences encountered while attending college and is, therefore, in addition, informative and educational in nature.

Briefly, each player of the game is assigned a playing token which is moved around the board from a starting location. Each traverse around the board corresponds to a college semester. A player graduates after eight semesters, and wins the game if, upon graduation, he has the highest grade point average. A player who has completed eight semesters, but who does not have the highest grade point average, may repeat a semester to improve his grade point average. During the game, the players move their respective tokens along alternate travel paths which have different numbers of movement steps. A manual is provided with special entries indicating bonuses and penalties corresponding to typical college experiences. The bonuses and penalties are divided according to the particular college semester or pair of semesters composing a class year. The particular action taken by the player for each of the bonuses and penalties depends upon the particular one of the alternate travel paths which the player is on at the time. In choosing the particular path of travel, the player must, therefore, evaluate the relative risks and merits associated with the selected path.

A feature of the invention is a two-piece playing token; each player normally traversing the board with one piece of his respective token indicating that the player is in a normal status. The addition of the second portion of the playing token to the first portion indicates a changed status of the player.

BRIEF DESCRIPTION OF THE DRAWINGS

The principles underlying the present invention will be best understood from the detailed description of a preferred embodiment and from the claims when read in conjunction with the accompanying drawings wherein:

FIG. 6 is representative of the 40 Course Cards provided with the game;

FIG. 7 is representative of the 50 Red Cards provided with the game;

FIG. 8 is representative of the 50 White Cards provided with the game;

FIG. 9 is representative of the five different Credit Cards utilized to represent grades, a combination of 410 of these cards being provided with the game;

FIG. 10 is representative of the back side of 34 Report Cards provided with the game;

DETAILED DESCRIPTION OF A PREFERRED EMBODIMENT

The object of one game, "Magna Cum Laude," embodied in the present invention involves attaining a specific goal; that goal being to graduate first with the highest grade point average (GPA). Each traverse around the game board constitutes a semester; a pair of semesters constitutes a college year.

If, upon graduation, a player has a higher GPA than any other player in, or repeating, a semester of his senior year, such graduating player wins and the game is over. If such graduating player does not have the highest GPA, he may elect to repeat as many as five courses per semester to raise his lowest grades; previous grades cannot be lowered. If no other player has, in the meantime, graduated with the highest GPA, upon completion of a repetitive semester, a graduating senior who then has the highest GPA of any player in, or repeating, a semester of his senior year, such graduating senior wins, and the game is over.

Figure 1:
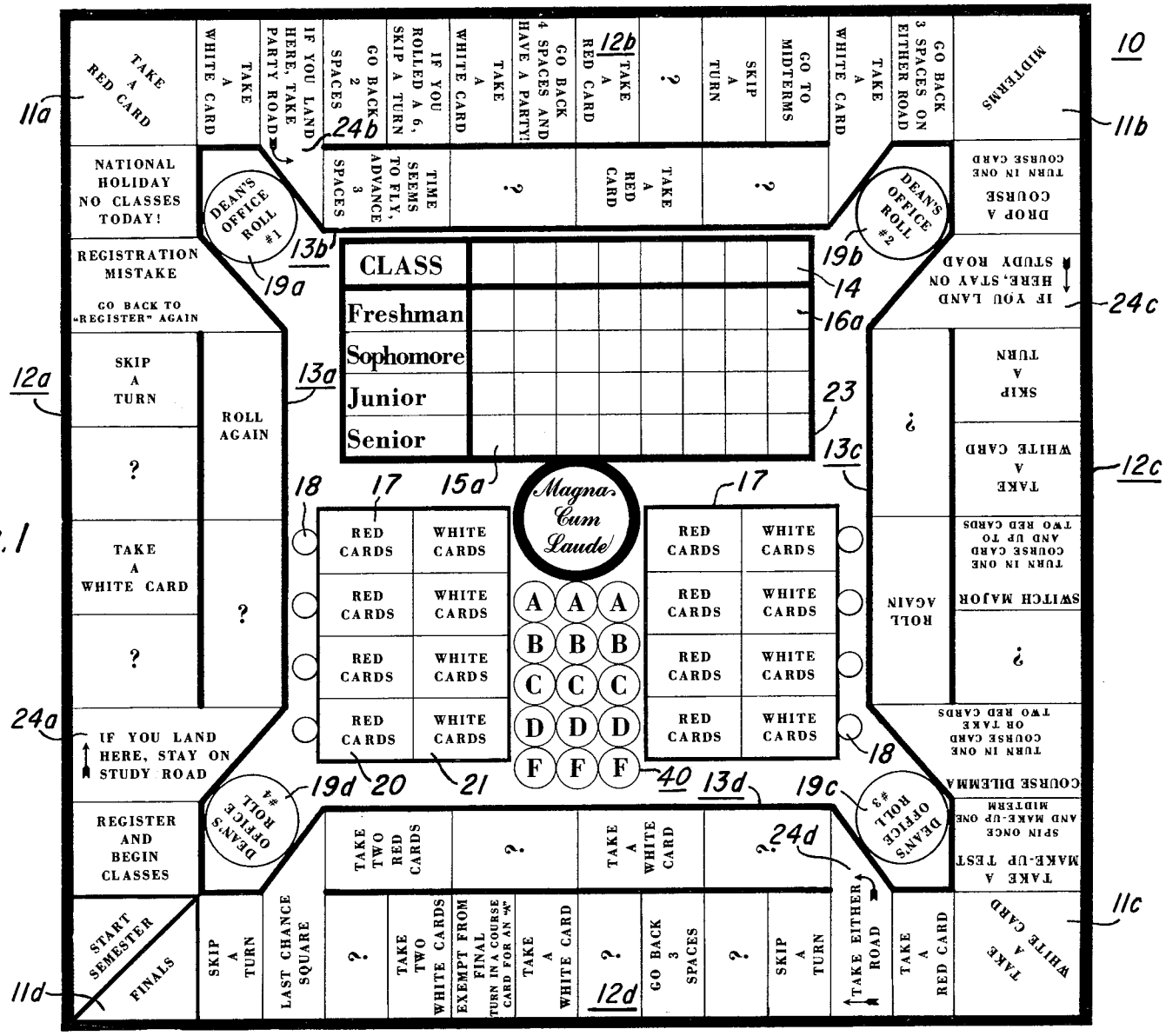
FIG. 1 is a plan view of one form of an arrangement of a board or playing field for the game, the lettering on the representative spaces being clearly indicated.

The grade point average (GPA) is calculated as the total number of quality points earned for all semesters completed divided by the total number of courses taken (credits). A player needs a minimum of 80 quality points and completion of 40 courses to graduate. An exemplary game board or playing field, utilized in this embodiment, is illustrated in FIG. 1. Referring then to FIG. 1, game board 10 is shown having corner spaces 11*a*-11*d*, and first and second sets of intervening spaces therebetween; the first set including sections 12*a*–12*d* having a greater number (in this embodiment, twice the number) of spaces than the second set which includes sections 13*a*–13*d*. Thus, alternate paths of movement or travel are provided on each side of the game board. In this embodiment, some of the spaces, including corner spaces 11*a*–11*d* are common to the alternate paths to provide forks 24*a*–24*d*, by means of which paths may be switched. The first path of travel, designated the Study Road, because it incorporates the greater number of spaces, takes longer to traverse than the second path of travel, designated the Party Road. On the other hand, the shorter Party Road holds greater risks. The player of the game must evaluate and assess the relative risks and merits of these alternate paths of travel in obtaining the goal of graduating first with the highest GPA.

Figure 2:
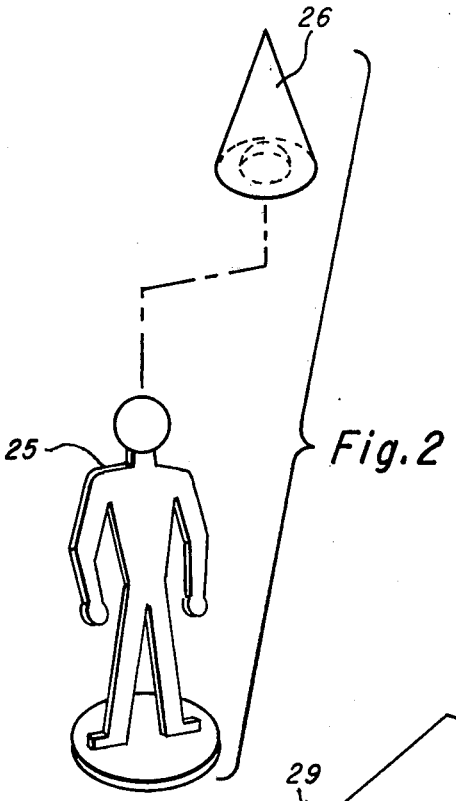
FIG. 2 is a perspective view of the two-piece symbols or tokens that are used by the several players, each player having a similar token coded with a different distinctive color which is assigned to the respective player.
Figure 3:
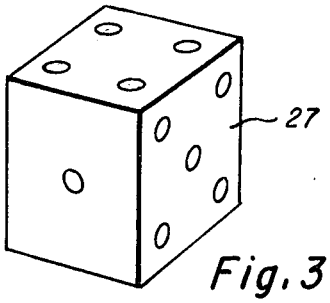
FIG. 3 is a perspective view of the single die used to determine the extent or length of the moves of the players along the selected paths of travel.
Figure 4:
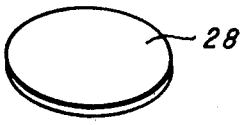
FIG. 4 is a perspective view of an indicator token utilized in conjunction with a "Class" chart marked on the playing board to indicate each player's classification.

To commence the game, each player receives a playing symbol or token such as the symbolic Student 25 illustrated in FIG. 2, and a White Card 36 shown in FIG. 8. Tokens 25, in the present embodiment, are color coded with each player being assigned a distinguished color. In addition, each player receives a maximum of five Course Cards 34, illustrated in FIG. 6, indicating that the player will be taking five courses the first semester. Game board 10 includes a Class Chart 23 which, along the upper edge thereof, includes a series of colored squares 14 designating, by color, a column 15*a* for each player to keep track of his class year: Freshman (first and second semesters), Sophomore (third and fourth semesters), Junior (fifth and sixth semesters) or Senior (seventh and eighth and repeated semesters). Each player, therefore, also receives a marker, such as disc or chip 28, illustrated in FIG. 4, which is placed at his particular class year in the respective column 15*a* designated by his assigned color code.

Initially, all players, in turn, roll the die; the player with the highest roll being first in turn for the remainder of the game, the player with the next highest roll being second in turn, etc. During play of the game, each player takes one turn which is a roll of the single die 27 and this is repeated until the end of each semester.

When approaching a fork 24*a*–24*d*, the player is free to choose whichever path he wishes to proceed along unless he lands directly on one of the spaces 24*a*–24*d*; in which case, the player, in his next move, follows the path directed by such space. Moving backward is prohibited unless specifically directed by landing on a square so indicating.

Figure 12:
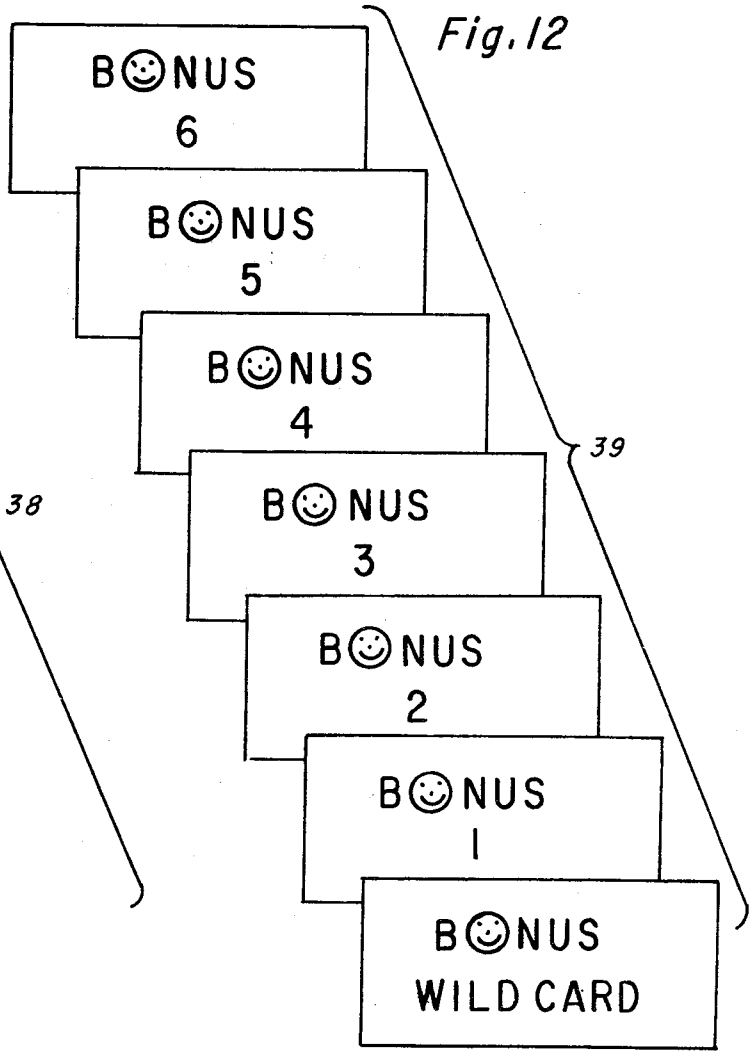
FIG. 12 is representative of the face side of the seven different bonus Report Cards.
Figure 11:
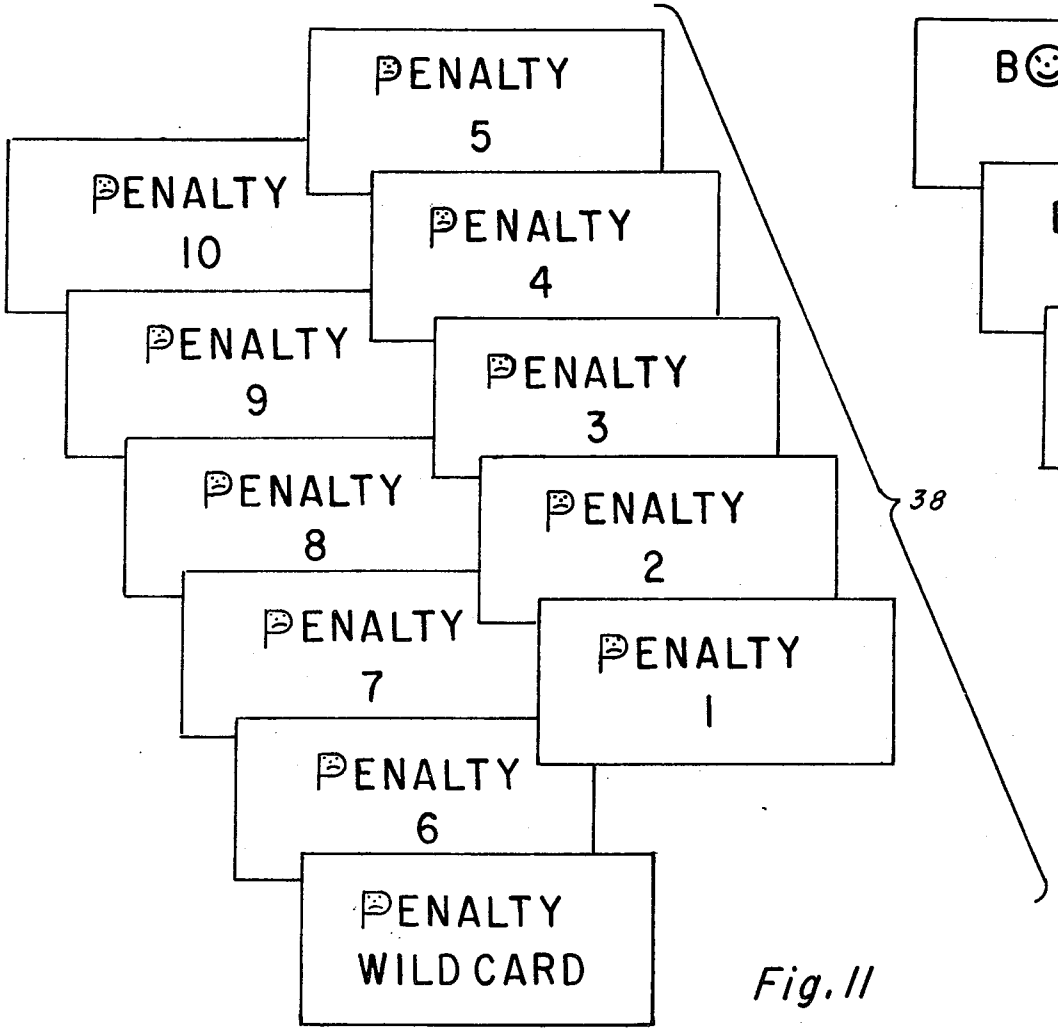
FIG. 11 is representative of the face side of the eleven different penalty Report Cards.

If a player lands on a question mark (?), he must take the first Report Card, the face 33 of which is shown in FIG. 10, from a stack of such cards. The selected Report Card may be either a Penalty Card 38, examples of which are shown in FIG. 11, or a Bonus Card 39, examples of which are shown in FIG. 12. The Report Card directs the player to a specific numbered penalty or bonus in a manual (blue book) which is included as a part of the apparatus of the present embodiment. The entire contents of the manual are given in TABLES I – IX below. It is essential that the player use the section which matches his respective class year: Freshman, Sophomore, Junior, or Senior. Freshman bonuses are shown in TABLE I; Freshman penalties are shown in TABLE II; Sophomore bonuses are shown in TABLE III; Sophomore penalties are shown in TABLE IV; Junior bonuses are shown in TABLE V; Junior penalties are shown in TABLE VI; Senior bonuses are shown in TABLE VII and Senior penalties are shown in TABLE VIII. Wild cards are the same for all classes and are shown in TABLE IX.

Printed storage means 17 is provided on game board 10 for each player to store his accumulated Red and White Cards. Each player has a space 20 for storage of his Red Cards 35 (shown in FIG. 7) and a space 21 for storage of his White Cards 36 (shown in FIG. 8) designated by a colored circle 18 corresponding to the color code assigned to the respective player. Red Cards 35 are penalties, and White Cards 36 are bonuses. At the end of each semester, White Cards 36 are utilized to cancel any Red Cards 35 on a one-to-one basis.

TABLE I

Freshman Bonuses

1. Course material same as high school.
   Take two white cards.
2. Social club's tutoring sessions really help.
   Take two white cards.
3. Copy of old test is practically duplicate of one just taken.
   Take one white card.
4. There are not many bonuses in your freshman year and, unfortunately, this is not one of them.
5. Dorm roommate turns out to be a scholar.
   Study road: He tutors you.
   Take two white cards.
   Party road: He does your homework.
   Take one white card.
6. New car helps you get around campus.
   Take another turn.

TABLE II

Freshman Penalties

1. Shouldn't have missed freshman orientation!
   Study road: Go back two spaces.
   Party road: Go back four spaces.
2. Joined social club and, in this case, activities hinder study!
   Study road: Skip a turn.
   Party road: Take one red card.
3. Can't find your way around campus.
   Study road: Go back three spaces.
   Party road: Skip a turn.
4. Went out to have a beer but ended up loaded and didn't finish assignment.
   Take one red card.
5. Went to library to study but were distracted by the "interesting sights."
   Take one red card.
6. Too bad, your books were stolen before the test.
   Study road: Teacher gives you a break and lends you his.
   Party road: You don't deserve a break.
   Take one red card.
7. Went home for the weekend and your car broke down coming back. Too bad you missed the test.
   Study road: Teacher gives you a make up test.
   Party road: No such luck. Take one red card.
8. "Loved one" back home got married and you can't concentrate on lessons.
   Study road: Switch to party road and move back three spaces.
   Party road: Go party, and try to get this incident off your mind. Skip a turn.
9. Someone flooded your dorm floor.
   Study road: Your notes got soaked.
   Take one red card.
   Party road: Campus security wants to have a talk with you.
   Skip two turns.
10. Personality conflict with graduate student teacher.
   Study road: Go back three spaces.
   Party road: Take one red card.

TABLE III

Sophomore Bonuses

1. Study hall sessions help you prepare well for a test.
   Take one white card.
2. Got notes to a course from upperclassman.
   Take one white card.
3. Been brown-nosing teacher all semester and pays off on borderline test grade.
   Take one white card.
4. Everything is going smoothly so far.
   Take another turn.
5. Going to class regularly paid off on a pop test.
   Take one white card.

6. You made the highest test grade in the class.
   Before mid-term: Take two white cards.
   After mid-term: Turn in a course card for an automatic "A."

TABLE IV

Sophomore Penalties

1. Switched major so you lose one course credit.
   Turn in worst credit.
2. Sophomore study slump.
   Study road: Switch to party road and skip a turn.
   Party road: Skip two turns.
3. Professor believes you cheated on a test and gave you a zero.
   Study road: Convinced the teacher you didn't cheat; "Lucky!"
   Party road: Take two red cards.
4. Took holiday vacation a few days early and missed a pop test.
   Study road: Able to take a make-up.
   Skip a turn.
   Party road: Take one red card.
5. You took a make-up test only God could have passed.
   Study road: Studied right material for wrong test.
   Take one red card.
   Party road: God got an "A", you got two red cards.
6. Part-time job cuts down on study time.
   Study road: Try harder.
   Skip a turn.
   Party road: Go back four spaces.
7. Caught mononucleosis and bedridden for over a week.
   Go back five spaces.
8. Accused of plagiarism; could be serious.
   Study road: Proved it wasn't you.
   Party road: Teacher gives you one alternative — drop course.
   Turn in one course card.
9. Got bad advice from a friend on what professor to take. Drop the course.
   Turn in one course card.
10. Had a blind date with professor's relative; too bad you didn't know beforehand.
   Take one red card.

TABLE V

Junior Bonuses

1. Have learned how to study effectively.
   Take one white card and another turn.
2. Summer job helped in your major field.
   Cash in course card for automatic "B."
3. This course is almost identical to course you had last semester.
   Take two white cards.
4. Advised by a friend to register in a particular section and the advise was good.
   Take one white card.
5. Hard test was accidentally graded wrong by the computer and you got an "A"!
   Take one white card.
6. Paper grader is easy.
   Turn in one red card if you have one.

TABLE VI

Junior Penalties

1. Switch majors; you lose two course credits.
   Turn in your two worst credits.
2. Got books stolen before test.
   Study road: Take one red card.
   Party road: Take two red cards.
3. Got in car wreck; must hassle with insurance, police, arrangements, etc.
   Study road: Skip one turn
   Party road: Skip two turns.
4. Bicycle got ripped off; skipped class because of inconvenience.
   Study road: Go back three spaces.
   Party road: Skip one turn.
5. Pulled an all-nighter studying and ended up sleeping through test.
   Take one red card.
6. Term paper is due tomorrow and you haven't begun to write. Looks bad!
   Study road: Take one red card.
   Party road: Take one red card and go back three spaces and skip one turn.
7. These was a good movie on TV and you skipped studying for a test the following day.
   Study road: Take one red card.
   Party road: Take two red cards.
8. Got a copy of last year's test and thought you had it made. Too bad you didn't take the test last year.
   Study road: Take one red card.
   Party road: Take two red cards and skip a turn.
9. Got involved in an all night card game (and all day).
   Study road: Skip a turn and go to party road. (That's where you belong!)
   Party road: Skip two turns.
10. Forgot to bring notes and books to an open book test.
   Study road: Take one red card.
   Party road: Drop the course and turn in a course card.

TABLE VII

Senior Bonuses

1. "Practice makes perfect." This applies to taking tests also.
   Take two white cards.
2. Professor easy on graduating seniors.
   Study road: Take two white cards.
   Party road: Take one white card.
3. Anxious to finish senior year.
   Take another turn and double roll.
4. Have had this professor for previous courses and have mastered his teaching style.
   Take two white cards.
5. Senior class project takes up a lot of time but results in a good grade.
   Go back four spaces and take three white cards.
6. Did excellently in course; get exempt from final.
   Cash in a course card for automatic "A."

TABLE VIII

Senior Penalties

1. Senior class project has kept you from your other studies.

Study road: Take one red card.
Party road: Take one red card and skip a turn.

2. Books stolen again, plus notebooks.
Take one red card.

3. Cut class for a job interview and miss a pop quiz.
Study road: Take one red card.
Party road: Take two red cards.

4. Uncertain about life after college; lack of concentration hinders studies.
Study road: Just hang in there.
Party road: Skip a turn.

5. Started graduation partying a little too early which resulted in a "rocky road."
Study road: Take one red card.
Party road: Go back to mid-term. If before mid-term, go back to start and take one red card in either case.

6. Curriculum was changed and it is computed that you need a different course, so drop one.
Turn in one course card.

7. Got in argument with a professor over a controversial issue — your grades!
Study road: Skip a turn.
Party road: Skip two turns.

8. Did not pay library and parking fines which needed to be paid before graduation.
Study road: Skip a turn.
Party road: Skip two turns.

9. Studied all week for a test and professor postponed it.
Study road: Skip two turns.
Party road: You were lucky this time.

10. Caught "rare tropical disease."
Study road: Take two red cards.
Party road: Take three red cards.

TABLE IX

Wild Cards

Bonus
Part time job pertaining to your major has been an instrumental factor in obtaining good grades. Cash in two course cards for two automatic "A"'s.

Penalty
Financial and personal problems cause you to drop out of school this semester.
Turn in all cards for this semester and start over.

Figure 5:
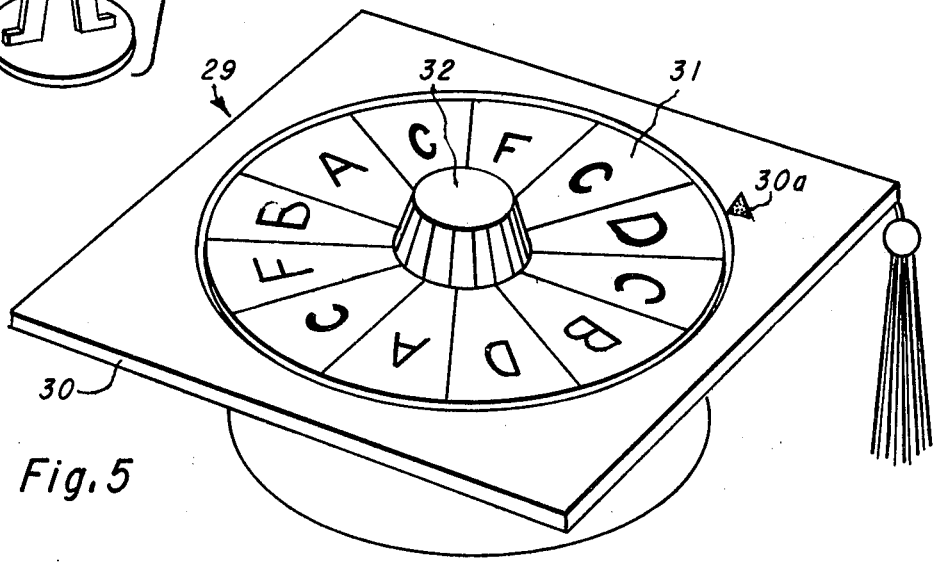
FIG. 5 is a perspective view of a wheel of chance utilized at various stages during play of the game to determine grades.

Referring now to FIG. 5, a Wheel of Chance 29 is provided for determining grades at the end of each semester and also during mid-terms. In this particular embodiment, Wheel of Chance 29 includes a base 30 configured in the shape of a graduation cap and a moveable wheel 31 which moves freely with respect to base 30 when spun by a player by means of knob 32. Friction will cause wheel 31 to stop in a random position to provide grade A, B, C, D or F as indicated by a marker arrow 30*a*. The finals grading procedure and the procedure for mid-terms will henceforth be described in detail.

When a player reaches space 11*b* marked Mid-Terms, he stops. He does not move his student token 25 through the mid-terms space 11*b* until his next turn, but instead, he spins wheel 29 once. The following cards are awarded for the corresponding grades indicated by arrow 30*a* when wheel 31 comes to a stop: two White Cards if an A is indicated; one White Card if a B is indicated; no cards if a C is indicated; one Red Card if a D is indicated and two Red Cards if an F is indicated.

Upon landing on the "Last Chance" square, a player has the option of dropping up to two courses. The player landing on this space may turn in up to two Course Cards, and up to two Red Cards for each Course Card turned in. Once a course is dropped by turning in the respective Course Card, such dropped course cannot be retaken until the following semester.

When a player reaches Finals square 11*d*, he stops, turns in as many White Cards 36 that he has accumulated during the semester as Red Cards 35, or vice versa, and waits until it is his turn again. If, after turning in these cards, the player has an excess of Red Cards, the player must take one extra spin of wheel 31 for each of such excess Red Cards. For example, if a player is taking five courses and has nine Red Cards and three White Cards, upon reaching Finals square 11*d*, he turns in three White Cards and three Red Cards. In determining his grades for each of the five courses, he must take one extra spin for each of four of the courses and two extra spins for one of the courses. After a player has landed on Finals square 11*d*, and turned in the requisite number of Red and White Cards, when it is his turn again, he turns in one Course Card and takes the number of spins for that course which is three plus any extra spins as indicated above. Markers 28 are placed in the appropriate circles 40 at the end of each spin to keep track of the grade received. After the appropriate number of spins for the particular course, the lowest grade indicated is the grade which the player receives for that course. If the player has an excess of White Cards, the player has the option of removing any of the grades he has accumulated for the course. For example, if a player who has additional White Cards spins three times for a particular course and accumulates an A, A, and F, he may turn in one of the excess White Cards to remove the F and receive an A (the lowest grade remaining for the course). As many White Cards as necessary may be turned in per course. Excess White Cards may be turned in only to remove the lowest grade or grades obtained; they cannot be utilized to increase grades in any other manner. If all spins are F's, then only an F may be received.

If a player receives an A, B, C or D, he passes the course, and receives a corresponding Credit Card 37 as shown in FIG. 9. Credit Cards 37 are utilized to record grades and courses completed until graduation. Each grade has an equivalent number of grade points as follows: "A" being equal to four quality points; "B" being equal to three quality points; "C" being equal to two quality points; and "D" being equal to one quality point. If an F is received, there is no credit or quality points, but an F card is handed out to the player for purposes of determining the player's GPA for that semester. That course is repeated the following semester.

The above procedure is repeated for each Course Card which the player has. After all spins of wheel 29 are complete, all remaining Red Cards 35 and White Cards 36 are turned in. The next five (or less, if selected by the player) Course Cards 34 and one White Card 36 are given to the player, and the player's next semester begins on his next turn. If a player needs less than five credits to graduate, he may substitute the grades he receives in any extra courses he desires to take for lower grades accumulated in prior courses. The grades received for these extra courses are utilized only to raise grades received in that or prior semesters. Grades cannot be lowered.

If a player does not receive a 2.0 GPA or higher (i.e., less than ten quality points earned for five Course Cards) for any semester, he is placed on probation. When placed on probation, a symbolic dunce cap 26 is affixed on the top (head portion) of the player's student token 25. The student token 25 must wear the dunce cap 26 as it is moved around the board the following semester. In the following semester, the player having a token with a dunce cap so affixed, can be removed from probation by getting a 2.0 GPA or better. If he does not, he flunks out.

When a player flunks out, he goes to the Dean's office to appeal and, in effect, skips four turns. This is accomplished by moving the player's token to the space 19*a*, and then to spaces 19*b*–*19d*, in each successive turn, and then finally back to space 11*d* to begin the new semester, on probation, with the symbolic dunce cap 26 affixed to the player's student token 25.

Upon completing ten credits, a player moves to the next higher college class. This is accomplished by the player moving his marker 28 to the next higher class in the respective column of class chart 23.

A preferred embodiment of a board game apparatus according to the present invention, along with the method of using the same, has now been described in detail. A short version of playing the above game would entail, for example, playing only the freshman and senior years for a 2-year junior college degree.

Since it is obvious that many additional changes and modifications can be made in the above-described details without departing from the nature and spirit of the invention, it is understood that the invention is not to be limited to said details except as set forth in the appended claims.

What is claimed is:

1. A game board apparatus for a plurality of players comprising:

a. a board having first and second alternate paths of travel indicated thereon, wherein:
   i. each of said paths consists of a series of spaces representing movement steps,
   ii. said first path includes a greater number of spaces than said second path,
   iii. a plurality of the spaces of said first path are coincident with a respective plurality of spaces of said second path, and
   iv. a plurality of the spaces of said first and second paths are action spaces, each directing that an action be taken by a player landing thereon;

b. action indicator means for specifying a plurality of pairs of actions to be taken by a player in response to landing on one of said action spaces, wherein:
   i. the first action of each pair is associated with said first path and the second action of each pair is associated with said second path, and
   ii. the first actions are statistically of greater relative benefit and less relative consequence than the second actions; and c. selection means for indicating which of said plurality of pairs of actions are to be followed when a player lands on one of said action spaces.

2. The game board apparatus according to claim 1 wherein said selection means is comprised of a randomly-shuffled set of cards, with each of said cards referencing a particular pair of the actions indicated by said action indicator means to be selected in response to landing on one of said action spaces.

3. The game board apparatus according to claim 1 wherein each of said players takes a turn in moving a number of steps along a selected one of said alternate paths of travel and wherein said apparatus includes means for indicating the number of movement steps to be taken by a player in any given turn.

4. The game board apparatus according to claim 3, wherein said means of indicating the number of movement steps includes at least one die.

5. The game board apparatus according to claim 1 including a plurality of tokens, one token being assigned to each of said players for moving in steps from space to space along the paths of travel selected by the respective players.

6. The game board apparatus according to claim 1 wherein said action indicator means includes means for specifying a plurality of classified groups of actions with each group having a plurality of pairs of actions, the group selected by a player in response to landing on one of said action spaces being directly related to the number of times a player has completely traversed the game board along either of said first and second alternate paths of travel.

7. A new and improved board game apparatus wherein players thereof evaluate and assess the relative risks and merits of alternate paths of movement to a desired goal during play of the game, comprising:

a. playing token means assigned to each player for movement by the assigned thereto player;

b. play determining means for randomly specifying one of a set of numbers of moves permitted each player during his playing turn;

c. a game board around which said playing token means are moved by the players as play of the game proceeds, said game board having formed thereon first and second alternate paths of travel, each of said paths consisting of a series of spaces representing movement steps, said first path having a greater number of spaces than said second path with a plurality of spaces of said first path being coincident with a respective plurality of spaces of said second path and with a plurality of spaces of said first and second paths being indicated as action spaces, each directing that an action be taken by a player landing thereon;

d. action indicator means for specifying a plurality of pairs of actions to be taken by a player in response to landing on one of said action spaces wherein:
   i. the first action of each pair is associated with said first path and the second action of each pair is associated with said second path, and
   ii. the first actions are statistically of greater relative benefit and less relative consequence than the second actions; and e. selection means for indicating which of said plurality of pairs of actions are to be followed when a player lands on one of said action spaces.

8. The game board apparatus according to claim 7 wherein said selection means is comprised of a randomly-shuffled set of cards, with each of said cards referencing a particular pair of the actions indicated by said action indicator means to be selected in response to landing on one of said action spaces.

9. The game board apparatus according to claim 7 wherein said action indicator means includes for specifying a plurality of classified groups of actions with each group having a plurality of pairs of actions, the group selected by a player in response to landing on one of said action spaces being directly related to the number of times a player has completely traversed the game board along either of said first and second alternate paths of travel.

10. A new and improved board game apparatus which simulates a college program wherein the players thereof evaluate and assess the relative risks and merits of alternate paths of movement to the desired goal of graduating with the highest grade point average, comprising:

a. playing token means assigned to each player for movement by the assigned thereto player;

b. play determining means for randomly specifying one of a set number of moves permitted each player during his playing turn;

c. a game board around which said playing token means are moved by the players as play of the game proceeds, each traverse around the game board comprising a college semester, said game board having formed thereon:

i. first and second alternate paths of travel, said first path of travel being a Study Road and said second path of travel being a Party Road, each of said paths consisting of a series of spaces representing movement steps with the Study Road having a greater number of spaces than the Party Road and with a plurality of the spaces of each of said paths being indicated as action spaces for directing that an action be taken by a player landing thereon, and ii. means by which the players may transfer from one of said roads to the other of said roads;

d. action indicator means for specifying a plurality of pairs of bonus actions and a plurality of pairs of penalty actions to be taken by a player in response to landing on one of said action spaces wherein:

i. the first actions of the pairs are followed by players landing on action spaces of said Study Road and the seoond actions of the pairs are followed by players landing on action spaces of said Party Road, and ii. the bonuses and penalties comprising said first actions are statistically of greater relative benefit and less relative consequence than the bonuses and penalties comprising the second actions; and c. means for indicating which of said plurality of paris of actions are to be followed by a player when such player lands on one of said action spaces.

11. The game board apparatus according to claim 10 wherein the pairs of actions specified by said action indicator means are divided into groups, one group for each pair of college semesters, and wherein the group selected by a player in response to landing on one of said action spaces is dictated by the college semester of the respective player as determined by the number of times such player has completely traversed said game board.

12. A game board apparatus for a plurality of players comprising:

a. a board having first and second alternate paths of travel indicated thereon, wherein:

i. each of said paths consists of a series of spaces representing movement steps, ii. said first path includes a greater number of spaces than said second path, iii. means is provided at predetermined points along said paths for the players to transfer between said first and second paths, and iv. a plurality of the spaces of said first and second paths are action spaces, each directing that an action be taken by the player landing thereon; and b. action indicator means for specifying a plurality of pairs of actions to be taken by a player in response to landing on one of said action spaces, wherein:

i. the first action of each pair is selected by a player landing on an action space of said first path and the second action of each pair is selected by a player landing on an action space of said second path, and ii. the first actions are statistically of greater relative benefit or less relative consequence than the second actions; wherein c. the players evaluate and assess the alternate paths of movement to a desired goal during play of the game.

13. The board game apparatus according to claim 12 including selection means for indicating which of said plurality of pairs of actions are to be followed when a player lands on one of said action spaces.

14. A new and improved board game apparatus wherein the players thereof follow a path of movement to a desired goal during play of the game, comprising:

a. playing token means assigned to each player for movement by the assigned thereto player, said playing token means being comprised of first and second portions with said second portion being affixable to said first portion for indicating that the respective player has not satisfied a predetermined condition.

b. play determining means for randomly specifying one of a set of numbers of moves permitted each player during his playing turn; and c. a game board around which said playing token means are moved by the players as play of the game proceeds, said game board having formed thereon at least one path of travel consisting of a series of spaces representing movement steps and at least one delay space, said delay space being separate from said path of travel for storing the playing token of a player, who has not satisfied said predetermined condition after traverse of a predetermined number of spaces along said path of travel with the second portion of such players playing token means affixed to the first portion thereof, during one of his playing turns to thereby provide a loss of turn.

15. The board game apparatus according to claim 14 wherein a plurality of delay spaces are provided, said delay spaces forming a delay path separate from said path of travel wherein a player, losing a predetermined number of turns, moves his respective playing token from delay space to delay space until said delay path is completed.

* * * * *